US006176397B1

(12) United States Patent
Robbins et al.

(10) Patent No.: US 6,176,397 B1
(45) **Date of Patent: *Jan. 23, 2001**

(54) GRANULAR MATERIAL CONTAINER AND DISPENSER

(75) Inventors: E. Stanley Robbins, Killen; Rodney W. Robbins, Florence; Frans M. Weterrings, Tuscumbia; Ted A. Bell, Killen, all of AL (US)

(73) Assignee: Robbins Industries Inc., Florence, AL (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/136,991

(22) Filed: Aug. 20, 1998

Related U.S. Application Data

(62) Division of application No. 08/742,515, filed on Nov. 1, 1996.

(51) Int. Cl.[7] ..... B67D 5/60
(52) U.S. Cl. ..... 222/144; 222/368
(58) Field of Search ..... 222/144, 185.1, 222/368, 444, 448, 565

(56) References Cited

U.S. PATENT DOCUMENTS 2,678,253 5/1954 Rosenberg .
4,562,941 * 1/1986 Sanfilippo ..... 222/185.1 X
4,569,963 * 2/1986 Pellegrino ..... 222/185.1 X
4,592,480 * 6/1986 Hart et al. ..... 222/541 X
4,989,759 2/1991 Gangloff ..... 222/153
4,993,583 2/1991 Chasen .
5,244,270 9/1993 Parker .
5,351,861 * 10/1994 Jovellana ..... 222/144
5,826,754 * 10/1998 Ishaya et al. ..... 222/185.1

* cited by examiner

*Primary Examiner*—Andres Kashnikow
*Assistant Examiner*—Jorge Bocanegra
(74) *Attorney, Agent, or Firm*—Kramer Levin Naftalis & Frankel LLP; Gregor N. Neff

(57) ABSTRACT

The container is adapted to be releasably secured to a rotatable turntable. It has a pie-shaped cross section, with a recess in the bottom to receive a projection to hold it in place on the turntable. Another projection projects laterally from the narrow end of the container to mate with a receptacle on the turntable to prevent the container from being tipped off of the turntable. The container has a sloping hinged cover for a large opening on the top, and a hinged cover for a small shaker opening in the top. In one embodiment, the container has a dispensing opening in the bottom and a rotary dispenser operable from outside the container for dispensing pre-measured quantities of materials through the bottom opening.

18 Claims, 7 Drawing Sheets

70
48
70
46
71
66
47
44
64
64
67
68
62
66
68
67
30
22
32
34
52
30
34
42
60
63
38
28
69
36
50
52
40
42
38
36
56
58
26
54
79
47
56
78
47
72
74
76

FIG. 7
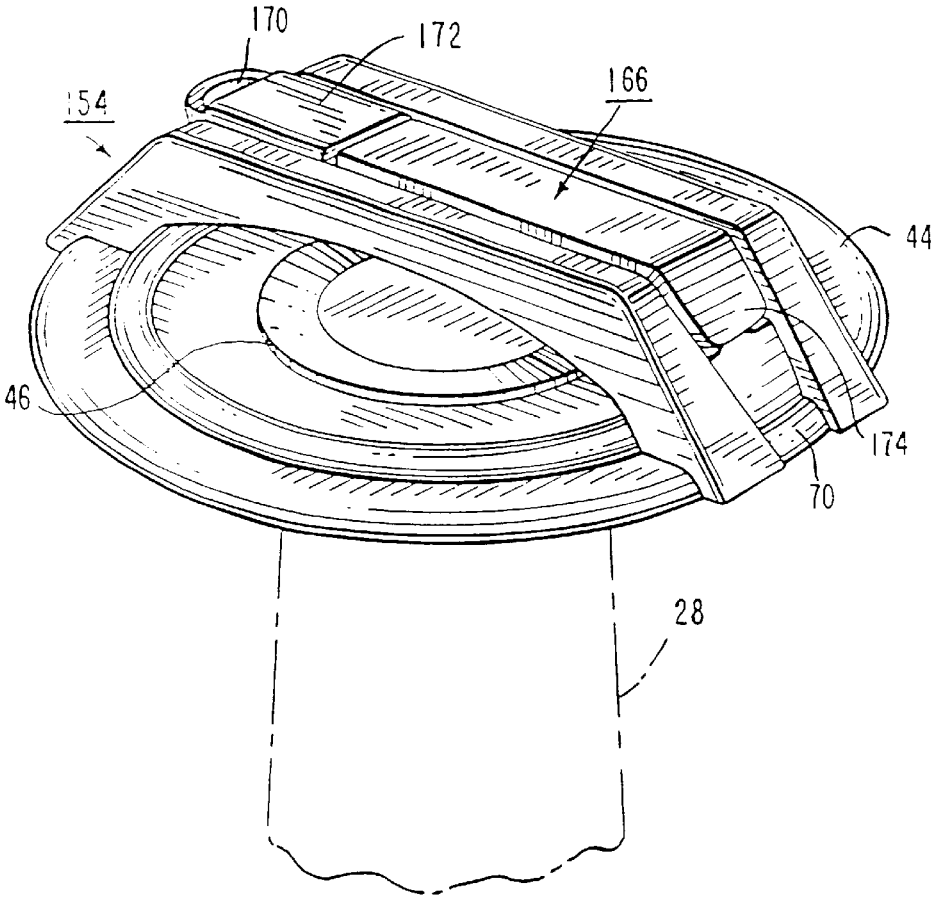
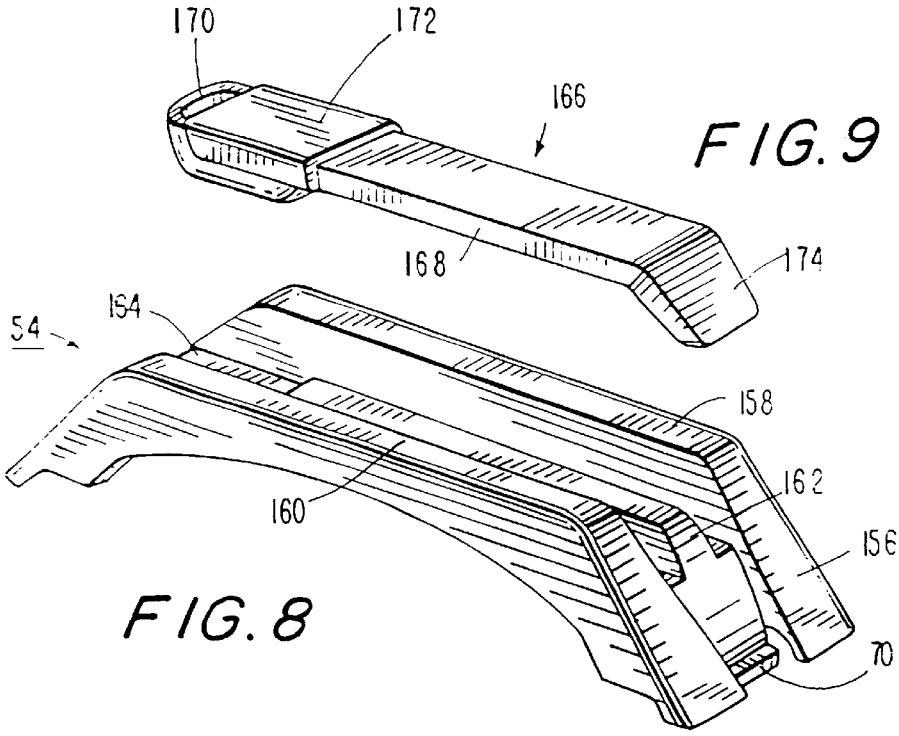
FIG. 9
FIG. 8

GRANULAR MATERIAL CONTAINER AND DISPENSER

This is a division of pending prior application Ser. No. 08/742,515, filed on Nov. 1, 1996, by E. Stanley Robbins, Rodney W. Robbins, Frans M. Weterrings and Ted A. Bell, and currently entitled TURNTABLE STORAGE DEVICE.

This invention relates to turntable storage devices and to granular material storage and dispensing containers. More particularly, this invention relates to such devices for use in storing and dispensing granular materials such as condiments.

Most prior turntable storage devices suffer from a lack of versatility in mounting and handling, insufficient ease of dis-assembly and assembly, and/or insufficient ability to hold storage containers. Condiment dispensers used with such devices often are not sufficiently easy to use and dispense accurately-measured quantities of condiments.

For example, although turntable devices have been proposed in which separate units can be stacked on top of one another, the separate units are not believed to be usable separately.

Similarly, although turntable devices have been proposed which can be hung from the bottom of a shelf, such devices are not believed to be capable of being stacked together and/or hung from a shelf. Also, they do not have a detachable carrying handle to make them portable.

Prior proposed turntable condiment storage devices lack means for holding condiment containers securely in place, and for accurately dispensing pre-measured amounts.

Accordingly, it is an object of the present invention to provide a turntable storage device which is well suited to solving or alleviating the foregoing problems.

In particular, it is an object of the present invention to provide a turntable storage device which carries a plurality of containers for storing materials, such as flour, condiments, and other granular materials for the kitchen, as well as other small objects or materials.

It is another object of the present invention to provide a turntable storage device that can be mounted and used in a variety of different mountings and configurations.

It is a further object of the present invention to provide a turntable storage device wherein containers are securely held in place on a turntable to prevent them from sliding off of the turntable.

It is yet another object of the present invention to provide a turntable storage device wherein the parts are easily attached together and separated without tools.

In accordance with the present invention, the foregoing objects are met by the provision of a turntable storage device which has a turntable and a plurality of containers that are removably attachable to the turntable.

In one aspect, the invention comprises a novel convertible turntable. The turntable unit can be stacked with other units, or the units can be used separately. Alternatively, each unit or a stack of units can be suspended from the bottom of a shelf.

The turntable preferably includes a platform and a base member. The base member is integrally connected to an upwardly extending hollow post. Each unit has a detachable upper projection dimensioned to fit into the bottom opening of the hollow post of another unit and lock in position to enable the units to be stacked and thus occupy less shelf space, or to be used to attach the turntable to the underside of a shelf.

The upper projection is easily detachable and can be replaced with an easily-attachable handle for carrying the turntable.

The containers can be of any shape but are preferably wedge-shaped so that they provide maximum storage volume while fitting together snugly when assembled on the turntable.

In one embodiment, each of the containers has a measuring dispenser which is operable to dispense a predetermined quantity of material from the container. Preferably, the containers also include dispensing openings for spooning and shaking out the material.

In this embodiment, a rotary measuring dispenser, which is operable to dispense a predetermined amount of material, is located in each container. The dispenser includes an external knob attached to an internal metering rotor that has integral radially-extending spaced-apart blades defining a plurality of cavities between the blades. As the rotor is rotated, a measured quantity of material is dispensed through a hole in the bottom of the container for each partial revolution of the rotor equal to the angular separation between adjacent blades. As the knob is turned, the cavities are successively filled and then emptied through the dispensing hole.

In another embodiment of the invention, the individual condiment containers do not have individual metering dispensers. Instead, an adjustable measuring spoon is attached to the turntable. It is easily detached and is dimensioned to fit into the containers to dip out measured quantities of the contents.

Preferably, the top of each container contains two hinged dispensing openings, one for spooning out material from the container and another for shaking out material.

Each container can be securely positioned on the turntable by means of a projection located on each container, the projection or tab is received by a receptacle located on the platform. Preferably, the projection or tab is located on the bottom of the back wall of the container and the receptacles are located circumferentially around the upwardly extending post of the turntable.

The platform includes projections each of which is adapted to extend upwardly into a recess in the bottom of one of the containers to further hold the containers in place. Each projection forms a circumferentially extending ridge which engages a bottom edge of the container as it is positioned onto the platform, thus helping to prevent the container from slipping off of the turntable.

The foregoing and other objects and advantages will be set forth in or are apparent from the following description and drawings.

IN THE DRAWINGS:

FIG. 7 is a perspective view of a portion of an alternative embodiment of the invention;

FIG. 8 is a perspective view of a component of the structure shown in FIG. 7; and FIG. 9 is a perspective view of another component of the structure shown in FIG. 7.

GENERAL DESCRIPTION

Figure 1:
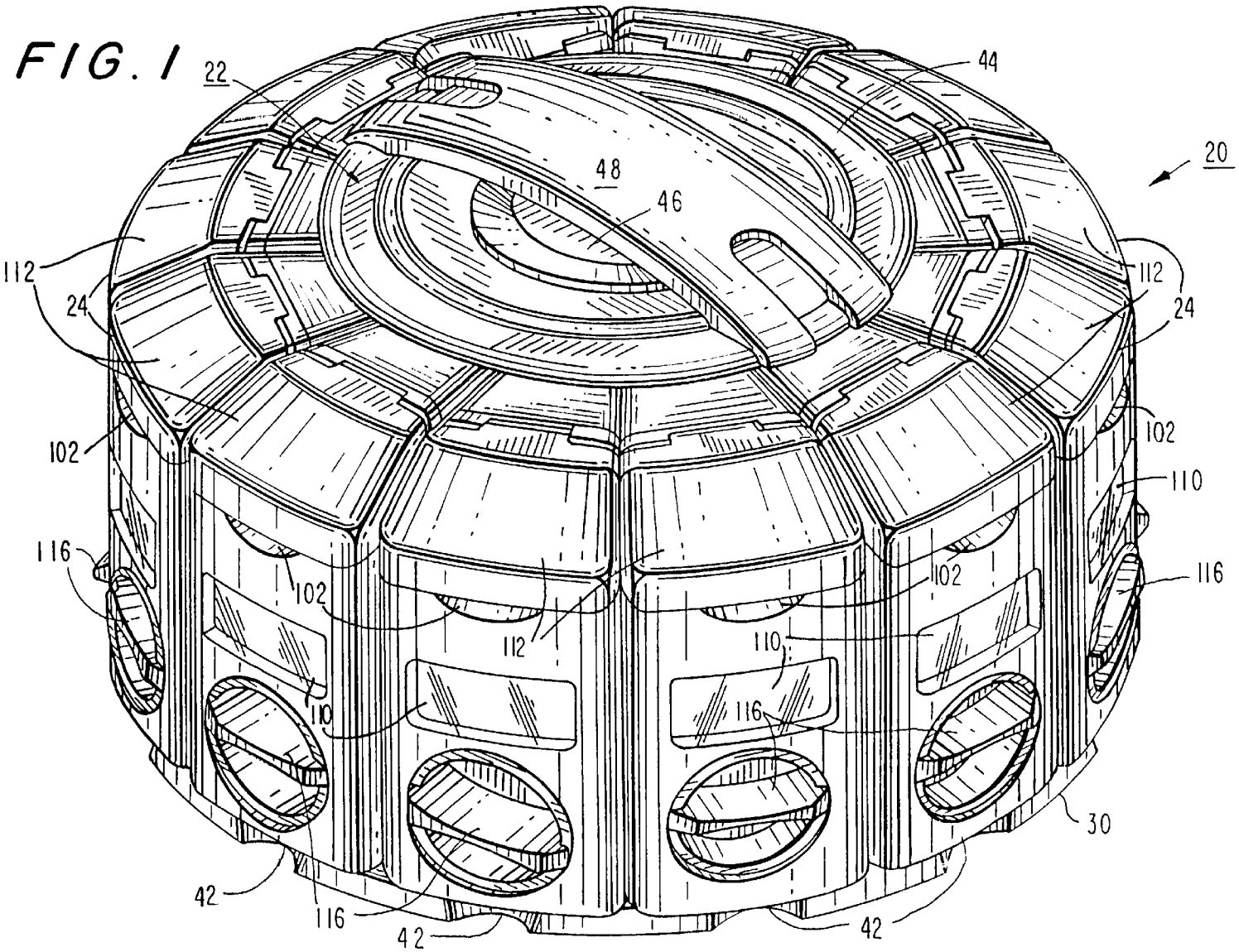
FIG. 1 is a perspective assembly view of a turntable dispenser device constructed in accordance with the present invention.

FIG. 1 is a perspective view of a turntable-dispensing device 20 constructed in accordance with the present invention.

Figure 2:
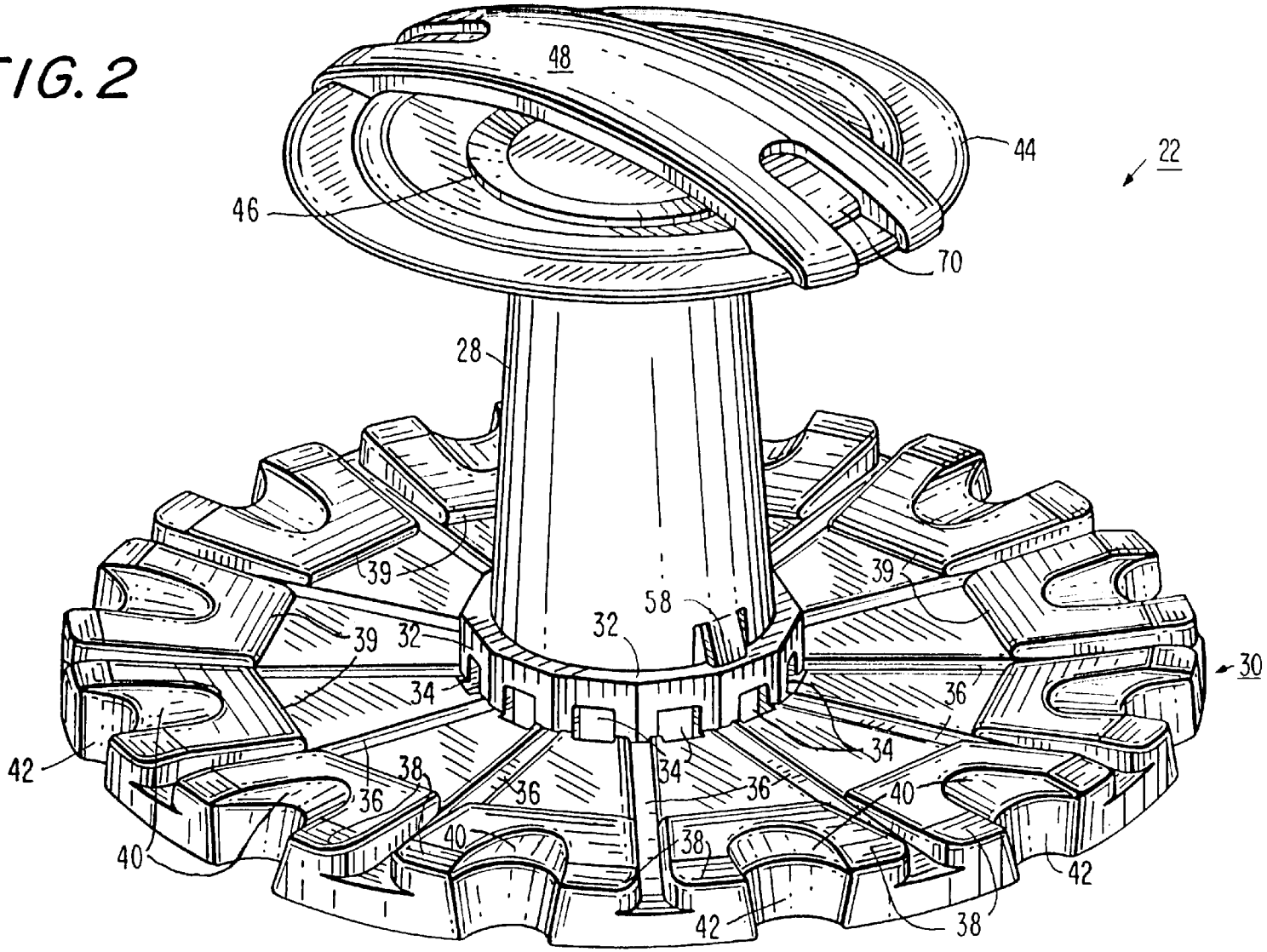
FIG. 2 is a perspective view of the turntable device shown in FIG. 1, with the containers removed from the turntable.
Figure 3:
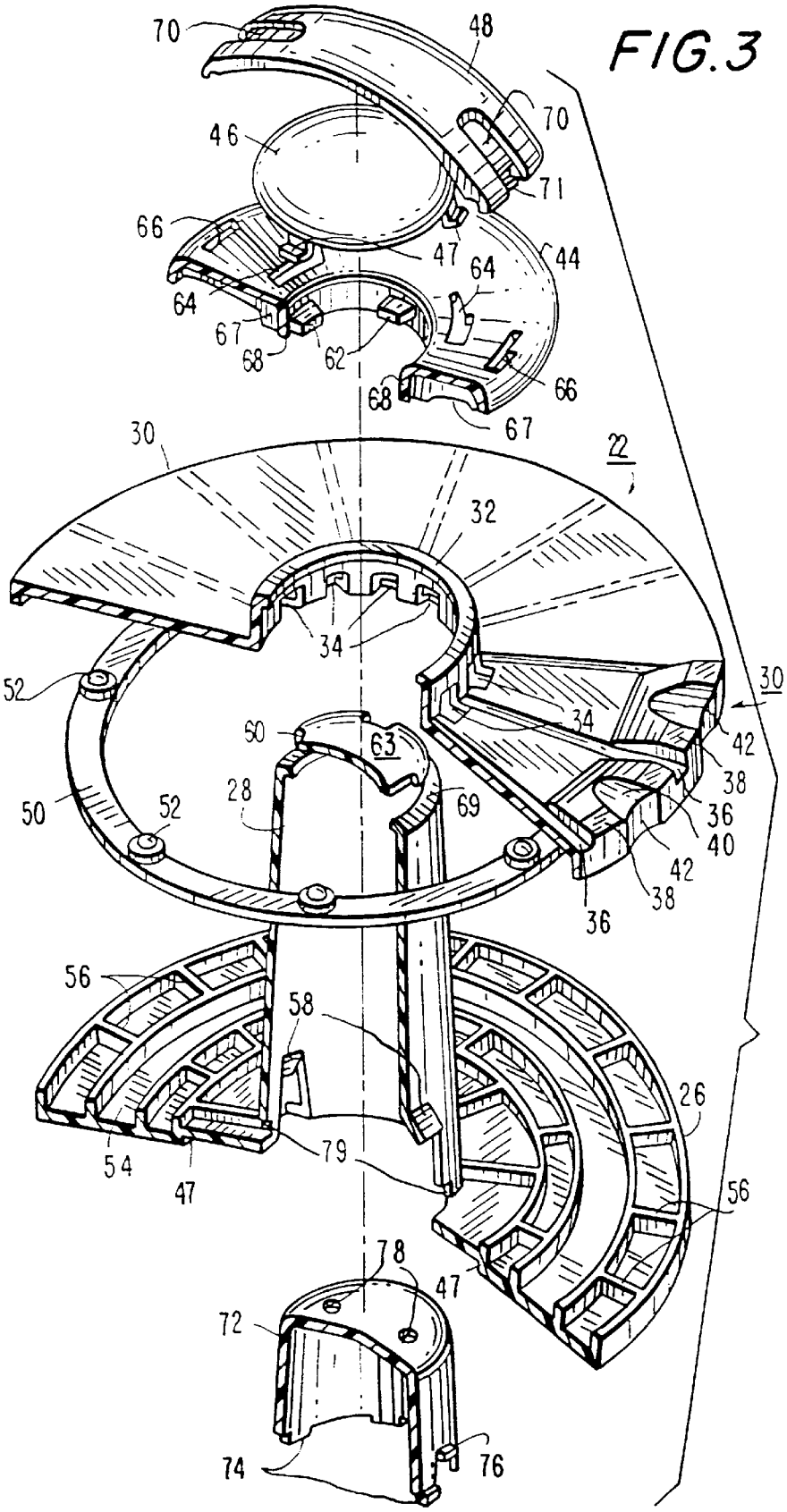
FIG. 3 is an exploded perspective, partially cross-sectional view of the turntable shown in FIG. 2.

The device 20 includes a turntable 22 and twelve containers 24 on the turntable. In FIGS. 2 and 3, the turntable 22 is shown separately, with the containers removed.

Referring to FIG. 3, the turntable includes a molded plastic base 26 with an integral central vertical post 28. A circular platform 30 (also see FIG. 2) is rotatably mounted on the base 26.

The platform 30 has a raised central hub 32 whose inner diameter is slightly larger than the diameter of the post 28 at its base so as to rotate freely around the post.

Referring to FIG. 2 as well as FIG. 3, the platform has twelve generally wedge-shaped receptacle structures, each for holding one of the containers 24 on the surface of the platform 30.

Each such receptacle structure includes an aperture 34 in the lower portion of the wall of the hub 32, a pair of shallow radial grooves 36, and a raised projection 38 located at the outer periphery of the platform 30 between the radial grooves 36. Each of the raised projections 38 is shaped generally like a portion of the bottom wall of each container 24 and is dimensioned to fit into a recess in the bottom wall of the container 24. The innermost edge 39 of each projection 38 mates with a vertical wall in each container to help prevent the container from falling off of the turntable.

It should be understood that only a relatively small number of the raised platforms and other container receptacle structures is shown in FIG. 3, for the sake of simplicity in the drawings.

Each of the projections 38 has a curved vertical recess 42 and a curved horizontal recess 40 to help in removing the containers from the turntable, and in order to present a pleasing ornamental appearance.

Referring again to FIG. 3, attached to the top of the post 28 is a disc 44. A decorative cover 46 covers the central opening in the structure, and a handle 48 is attached to the disc 44 for carrying the turntable.

As it will be explained in detail below, each of the containers 24 preferably has an integral metering dispensing device so that granular materials such as spices or other condiments can be dispensed from the container by removing it from the turntable, holding it over a receptacle into which the material is to be dispensed, turning a knob by a predetermined distance, and replacing the container on the turntable.

Each container alternatively can be used without a built-in measuring dispenser, and measured quantities of the materials can be removed from the containers by means of measuring spoons, etc. In particular, an alternative embodiment of the invention utilizes an adjustable measuring spoon which is conveniently attached to the turntable.

TURNTABLE DEVICE

Figure 4:
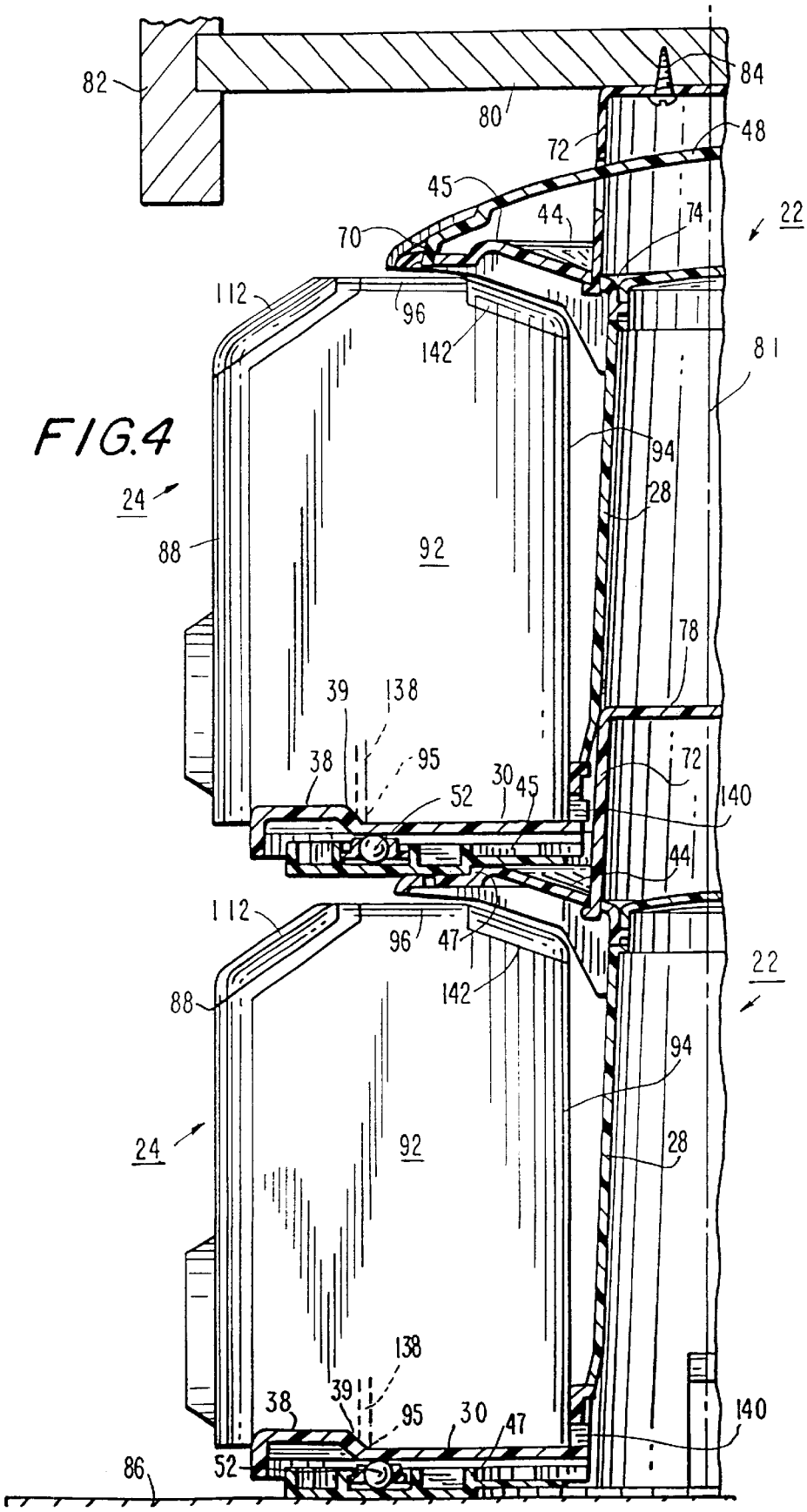
FIG. 4 is a partially cross-sectional, partially broken away and partially schematic elevation view illustrating certain features of the turntable dispenser device of the present invention with two of the devices stacked one on top of another and/or one or two of the devices being suspended from beneath a shelf.

Referring again to FIG. 3 as well as to FIG. 4, the rotatable platform 30 rotates on a ball bearing structure including a retainer ring 50 with a plurality of individual ball bearings 52 held in retainers on the ring 50. The ball bearing structure fits into a race 54 molded into the base 26. The base 26 has molded upstanding ridges 56 for the purpose of strengthening the turntable structure. It also has a recess 47 for receiving and seating the upper surface of one of the disc 44 when the turntable units are stacked.

The platform is easily assembled onto the base without tools by means of a pair of resilient locking tabs 58. After the ball bearing structure is seated in the race 54, the platform 30 is slipped downwardly over the post 28 and is pushed downwardly until the hub 32 moves past the tabs 58. The tabs 58 are flexed inwardly by the hub, and then snap outwardly as the hub 32 moves past the lower edges of the tabs 58.

The post 28 is slightly tapered from top to bottom; that is, it has a slightly smaller diameter at the top than at the bottom. This facilitates the assembly process described above, facilitates molding of the post and base structure, and facilitates the interference fit of a tapered attachment member inserted into the hollow interior of the post when stacking units atop one another.

The disc 44 also can be easily attached to the top of the post 28 and removed from it without the use of tools.

Figure 3A:
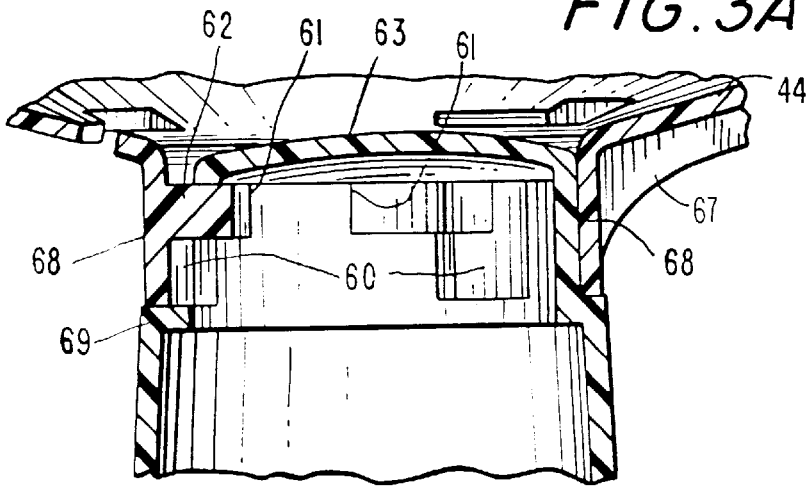
FIG. 3A is a cross-sectional elevation view of a portion of the turntable shown in FIGS. 2 and 3.
Figure 4A:
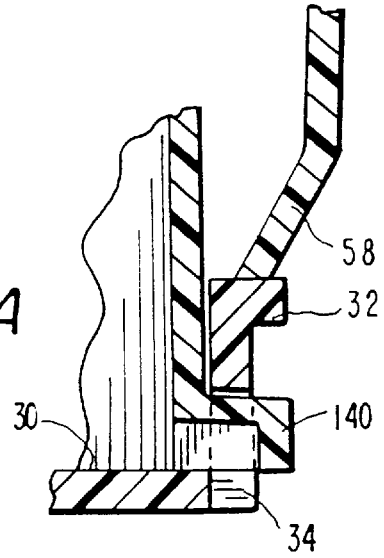
FIG. 4A is an enlarged, broken away elevation view of a portion of the structure shown in FIG. 4.

The top of the post is recessed so as to form a ledge 69. Three vertical slots (only two are visible in FIG. 3) 60 are formed in the vertical wall of the reduced diameter top potion of the post 28. A horizontal slot 61 (FIG. 3A) connects with each vertical slot 60. The notches 60 are dimensioned to receive three tabs 62 which extend inwardly from a hub 68 at central opening of the disc 44 so that the tabs 62 can be inserted into the slots 60. When the disc 44 is rotated, the tabs 62 slide into the slots 61 and engage the undersurface of the upper end wall 63 of the post 28 when the disc 44 is rotated (See FIG. 3A). The lower edge of the hub 68 rests on the ledge 69 so as to form a solid support for the disc 44 on the end of the post. The disc 44 has radial strengthening ribs 67.

The disc 44 can be removed from the structure simply by rotating the disc in the opposite direction to disengage the tabs 62 from the slots 60 and 61.

The cover 46 also is removably attached to the disc 44 by means of tabs 47 which fit into slots 64.

The handle 48 is removably attached to the disc 44 by means of locking tabs 70 which extend into locking slots 66 having a wide entrance and a narrower following slot so that the handle is locked into the slots 66 by rotation of the handle relative to the disc after inserting the tabs 70 in the slot. This causes the outwardly-extending feet 71 of the tabs to engage the undersurface of the disc.

MOUNTING HUB STRUCTURE

In accordance with another feature of the invention, as shown at the bottom of FIG. 3, a mounting hub or projection 72 is provided in order to facilitate stacking of turntables one on top of another, or for mounting one or more turntable devices onto the underside of a shelf.

The mounting hub is a molded plastic cylindrical structure, slightly tapered to match the taper of the inside of the hollow post 28. The mounting hub 72 either can be inserted into the hub and locked in place there, or mounted onto the disc 44 in place of the handle 48.

For insertion into the hollow interior of the post 28, the external dimensions of the hub 72 are slightly less than those of the interior of the post 48 so that when the hub 72 is inserted upwardly into the hollow post the hub will fit snugly, preferably with an interference fit. Two tabs 76 fit into the slots forming the tabs 58, and then slide into horizontal slots 79 when the hub 72 is rotated to lock the hub 72 and the post 28 together.

For attachment to the disc 44, the hub 72 is provided with three locking tabs or feet 74 which fit into the slots 64 so that when the hub 72 is rotated counterclockwise, the feet 74 will slide under the surface of the disc 44 and will be locked in place.

STACKED MOUNTING

FIG. 4 is a cross-sectional view of one half of a vertical stack of two of the turntable devices. It should be understood that, although a handle 48 is shown in FIG. 4, actually it would be removed in the stacked construction shown and is shown in FIG. 4 only for the convenience of illustrating its means of attachment.

In the stacked structure shown in FIG. 4, two hubs are in use; one hub 72 is inserted into the hollow interior of the post 28 of the upper turntable, and the other hub 72 is attached to the disc 44 of the upper turntable.

FIG. 4 is partially schematic in that it also shows how the stacked structure is attached by means of screws 84 to the under surface of a shelf 80, such as a shelf of a kitchen cabinet. The front of the cabinet is shown schematically at 82.

FIG. 4 also shows the stacked structure resting on a counter top surface 86, for the purpose of illustrating both types of mounting.

FIG. 4 also illustrates how the containers 24 are mounted on the turntable platforms, with the projection 38 extending into the recess in the bottom of the container, and the vertical wall 138 of the container engaging the rear edge 39 of the projection 38.

When the containers are removed, they are lifted upwardly at the outer edge and slid outwardly from the center of the turntable. This lifts the container off the projection 38, and allows the projection 140 at the rear of the container to be removed from the hole 34.

It should be understood that each of the turntable storage devices 22 can be used alone resting on a counter top such as the counter top 86, or each can be suspended from beneath a shelf alone, without being stacked together with another turntable unit. However, stacking the units is particularly advantageous in that it saves additional counter top space as compared with single stand-alone units.

When two units are stacked together, but not hung from beneath a shelf, the handle 48 shown in FIG. 4 then can be used to carry the stacked units to some other location, if desired.

DISPENSING CONTAINER

Figure 5:
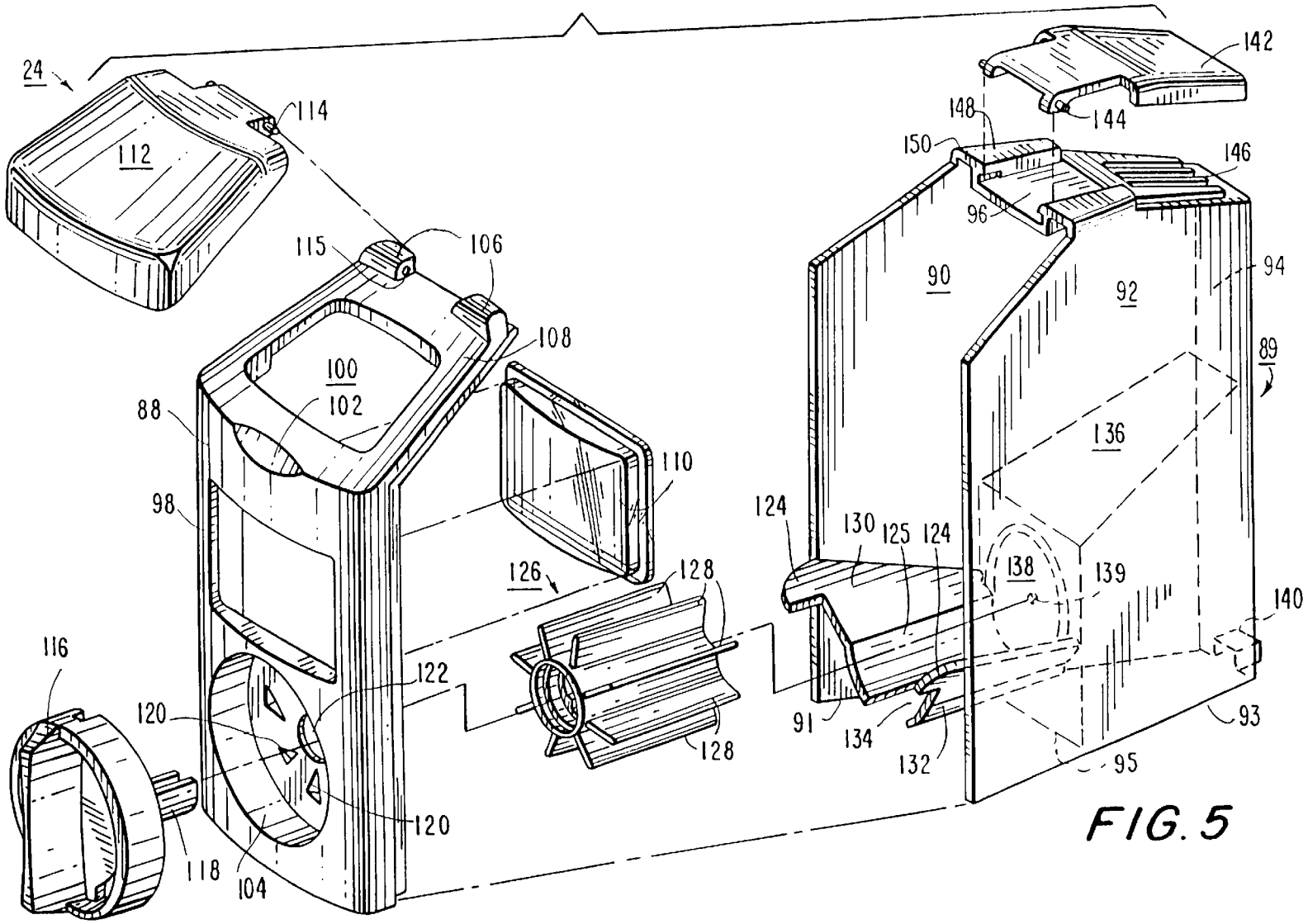
FIG. 5 is an exploded view of one of the dispensing containers shown in FIG. 1.

FIG. 5 is an exploded perspective view of one of the dispensing containers 24 shown in FIGS. 1 and 4. Each container includes a molded outer end wall 88, and a molded body unit 89. The body unit has two side walls 90 and 92, a rear wall 94, and an upper wall 96.

The front wall 88 has a sloping outer end surface 108 containing a large opening 100 for use in filling the container, and for pouring large quantities of the contents of the container, or for use in dipping the contents of the container out with a spoon.

The front wall 88 has a thumbnail recess to facilitate lifting a lid 112 which covers the opening 100. A circular recess 102 104 receives a rotary dial 116 with a shaft 118 which fits through a hole 122 and into a dispensing rotor 126 which has vanes 128.

The width of the innermost end wall 94 is much less than the width of the outer wall 88, thus giving the container a pie-shaped cross-section, as is desirable to enable a substantial number of the containers to be fitted onto the circular surface of the platform 30.

Internally within the container 24 are a sloping raised bottom wall 136 and a vertical wall 138 whose lower edge is shown at 95.

A pair of slanted bottom walls 130 and 132 are provided with a gap 134 between them. The walls 130 and 132 have end tabs 124 which fit into slots (not shown) in the rear of the front wall 88. The walls 130 and 132 have curved areas 125 to fit snugly against the rotor blades 128 to pre vent leakage of condiments.

When the front wall 88, the rotor structure 126, the knob 116, are all assembled together to form the housing, the half-cylindrical shaft 118 fits into a similarly-shaped hole in the rotor 126. The rotor 126 has a pivot hole in one end into which is fitted a pivot pin 139 which extends from the wall 138, and the vanes 128 contact the curved surfaces 125 of the members 130 and 132 to prevent material from being dispensed from within the container through the opening 134 until the rotor is rotated.

The front wall member 88 preferably is attached to the body member 89 by ultrasonic bonding.

When the rotor 116 is rotated, a quantity of material between two adjacent vanes 128 on the rotor 126 is dispensed through the opening 134 when the rotor is turned by the angular distance between two adjacent vanes 128. Since there are eight vanes on the rotor 126, a premeasured quantity of material is dispensed for every ⅛th of a revolution of the knob.

This dispenser is similar to that shown in U.S. Pat. No. 4,957,219, the disclosure of which hereby is incorporated herein by reference.

The easy measurement of predetermined quantities of materials is accommodated by the provision of a detent structure including eight depressions 120 which mate with two similar projections (not shown) on the rear surface of the knob 116. When the projections snap into the holes 120, this positively tells the user that the knob 116 has been turned through ⅛th of a revolution, and that one unit of volume has been dispensed.

The projections are shaped like ratchet teeth and the holes 120 are shaped so as to form a ratchet structure which allows the knob 116 to be turned in only one direction.

Another desirable feature of the container 24 is that it has a window 110 which is fitted into a opening 98 in the front wall 88. The window permits one to see the contents of the container.

The opening 100 is covered by a hinged lid 112 which has pivot pins 114 which fit into holes 115 in projections 106 extending upwardly from the upper edge of the front wall piece 88. Lid 112 has a ridge (not shown) which fits into the opening 100 to snugly close the opening.

The top wall 96 of the container also has a shaker grill 146 which is at the innermost edge of the container 24. A hinged cover 142 with hinged projections 144 fitting into notches 148 in the structure 150 provides a cover for the shaker grille.

Figure 6:
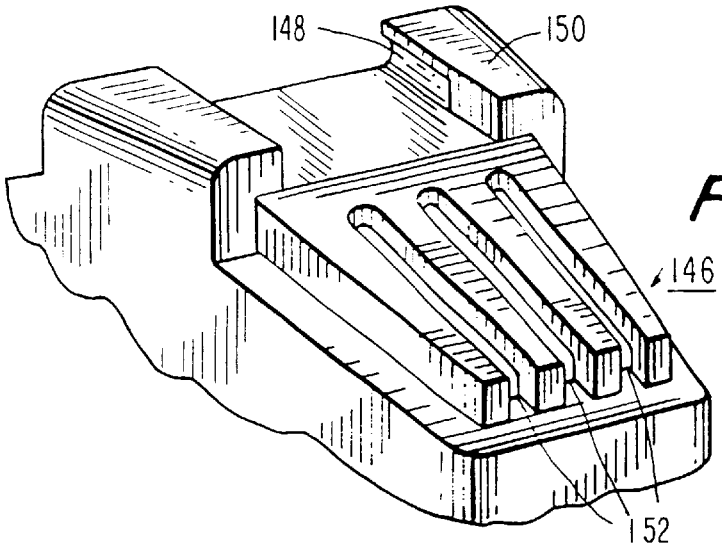
FIG. 6 is a perspective, broken-away view of a portion of the structure shown in FIG. 5.

FIG. 6 shows the shaker structure in greater detail. The grille includes a plurality of slots 152 in an upstanding projection. The undersurface of the cover 142 (not shown) has projections to fit into the slots 152 to close the grille completely and reduce accumulation of materials in the slots.

The location of the shaker opening at the end of the container where it is narrowest is advantageous in that it allows the funneling of the contents of the container towards the shaker outlet 146.

The bottom walls 130, 132, the rotor 126 and the wall of the recess 104 all are located above the bottom edges of the container walls so as to form the recess into which the projection 38 fits (See FIGS. 2 and 4).

The sloping bottom wall 136 guides material toward the rotor 126, and its bottom edge 95 engages with the rear edge 39 of the projection 38 as shown in FIG. 4.

NON-DISPENSING CONTAINER EMBODIMENT

In accordance with the another aspect of the invention, the cost of individual dispensing mechanisms for each of the containers 24 can be avoided by eliminating the dispensing mechanism in each, and providing a solid bottom wall for the container instead. Materials can be dipped out of the containers with spoons, or they can be dispensed through the shaker grille 146.

Alternatively, the dispensing of measured quantities of spices, flour, and other such granular materials can be achieved by use of a special handle structure shown in FIGS. 7, 8 and 9.

Instead of the handle 48 shown in FIGS. 1–3, a new handle structure 154 attached in the same way as handle 48 is provided. The handle structure 154 has a body 156 with two ridges 158 and 160 and a tapered projection 162 extending upwardly from between the two projections 158 and 160. A cavity 164 is provided at one end of the projection 162.

Fitted into this structure is an adjustable measuring spoon including an elongated body 169 with a tapered receptacle in the bottom to fit snugly onto the projection 162 to hold the measuring spoon releasably onto the handle.

The measuring spoon has a downwardly bent rear end 174, a slider 172 which has an end wall (not shown) which extends downwardly into a bowl 170 at the end of the spoon so as to provide an adjustable measuring cavity by sliding the slider 172 along the body of the adjustable measuring spoon 166.

In use, the adjustable measuring spoon 166 can be removed from the handle, set to the proper measurement desired, and inserted into the large opening 100 in one of the containers so as to remove a premeasured quantity of materials. Thus, the present invention provides a very handy means for mounting an adjustable measuring spoon so that it will be readily at hand when needed.

The material of which the turntable 22 and containers are made preferably is thermoplastic resin. The rotor 126 of the dispenser (FIG. 5) preferably is made of a relatively flexible plastic material such as sanoprene or low-durometer polyethylene. The flexibility of the blades minimizes grinding and binding of grains of condiments between the blades and their mating surfaces 125.

The covers 112 and 142 preferably are made of a flexible material such as polypropylene which is resistant to attack by spices.

This invention can be practiced in many different forms other than the specific forms described above. Those specific forms are described in order to set forth the best mode presently contemplated for carrying out the invention. However, the protection of this patent should not be limited to those forms and should be interpreted to cover other turntable storage devices utilizing the spirit and inventive contribution of this invention.

What is claimed is:

1. A condiment container having at least one vertical side wall, a top and bottom wall, said top and bottom walls being joined with said side wall to form an enclosure, said container having a generally truncated wedge-shape for a cross-section, said bottom wall having a dispensing opening, said top wall having a relatively large opening and a second opening with a grille over it for shaking condiments out of said container, and a dispenser mechanism operable from the outside of said container to dispense premeasured quantities of condiments through said dispensing opening, in which said bottom wall is recessed from the bottom edges of said at least one vertical side wall to form a recess with predetermined dimensions for receiving a projection of dimensions pre-determined to frictionally engage said projection in said recess.

2. A container as in claim 1 in which said dispenser mechanism has a rotary wheel with a rotor having vanes and a knob extending outside said container to use in rotating said rotor so as to cause the spaces between said vanes to successively fill and empty a quantity of condiments through said dispensing opening as said rotor is rotated.

3. A condiment container having at least one vertical side wall, a top and bottom wall, said top and bottom walls being joined with said side wall to form an enclosure, said container having a generally truncated wedge-shape for a cross-section, said bottom wall having a dispensing opening, said top wall having a relatively large opening and a second opening with a grille over it for shaking condiments out of said container, and a dispenser mechanism operable from the outside of said container to dispense premeasured quantities of condiments through said dispensing opening and a projection extending laterally from said at least one vertical side wall adjacent its bottom edge, said projection being dimensioned to fit into an opening in an adjacent wall to hold said container in position.

4. A condiment container having at least one vertical side wall, a top and bottom wall, said top and bottom walls being joined with said at least one vertical side wall to form an enclosure, said bottom wall having a dispensing opening, said top wall having a relatively large opening and a second opening with a grille over it for shaking condiments out of said container, and a dispenser mechanism operable from the outside of said container to dispense premeasured quantities of condiments through said dispensing opening, in which said top wall has one portion which slopes at an acute angle relative to said at least one vertical side wall, said large opening being located in said one portion.

5. A container for granular materials comprising a bottom wall, at least one side wall joined to said bottom wall, said at least one side wall having first and second sections forming an acute angle between them, and a third section joining said first and second sections to form a housing having a generally pie-shaped cross-section, a top wall covering said housing, said top wall having a wide end and a narrow end, said wide end sloping downwardly and joining said third wall section at an acute angle and having an opening with a removable cover, in which said at least one side wall has a bottom edge, and said bottom wall is recessed inwardly from said bottom edge to form a mounting receptacle dimensioned to fit onto and frictionally engage a mating projection from a mounting surface.

6. A container as in claim 5 including a transparent window in said third section.

7. A container as in claim 5 said bottom wall having a dispensing opening, a rotary dispenser mounted in said housing to dispense pre-measured quantities of material through said opening in said bottom wall, said dispenser having a rotary knob accessible at said third wall section for operating said rotary dispenser.

8. A container as in claim 5 in which said first and second side wall sections and said bottom wall section, and at least a portion of said top wall comprises a first molded structure, and said third side wall comprises a second molded structure attached to said first molded structure.

9. A container for granular materials comprising a bottom wall, at least one side wall joined to said bottom wall, said at least one side wall having first and second sections forming an acute angle between them, and a third section joining said first and second sections to form a housing having a generally pie-shaped cross-section, a top wall covering said housing, said top wall having a wide end and a narrow end, said wide end sloping downwardly and joining said third wall section at an acute angle and having an opening with a removable cover and including an opening with a grille in said narrow end of said top wall and a hinged cover over said grille to provide a shaker outlet for said container.

10. A container for granular materials comprising a bottom wall, at least one side wall joined to said bottom wall, said at least one side wall having first and second sections forming an acute angle between them, and a third section joining said first and second sections to form a housing having a generally pie-shaped cross-section, a top wall covering said housing, said top wall having a wide end and a narrow end, said wide end sloping downwardly and joining said third wall section at an acute angle and having an opening with a removable cover and in which said at least one side wall has a bottom edge, and including a lateral projection from said side wall adjacent said bottom edge in a direction away from said third section, said projection being positioned to mate with a receptacle on a mounting structure to hold it in place.

11. A container for granular materials comprising a bottom wall, a top wall, at least one side wall joined to said top and bottom walls, said at least one side wall having a first and second sections forming an acute angle between them, and a third section joining said first and second sections to form a housing having a generally pie-shaped cross-section, said top wall having a sloping portion, an opening in said sloping portion, and a removable cover for said opening, in which said at least one side wall has a bottom edge, and said bottom wall has a recess extending inwardly from said bottom edge and dimensioned to form a mounting receptacle for frictionally engaging with a mating projection from a mounting surface to hold said container on said surface.

12. A container for granular materials comprising a bottom wall, at least one side wall joined to said bottom wall, said at least one side wall having first and second sections forming an acute angle between them, and a third section joining said first and second sections to form a housing having a generally pie-shaped cross-section, a removable cover for said housing, in which said at least one side wall has a bottom edge, and said bottom wall has a recess extending inwardly from said bottom edge and dimensioned to form a mounting receptacle for engaging with a mating projection from a mounting surface and including a projection from said at least one side wall adjacent said bottom edge in a direction away from said third section, said projection being positioned and dimensioned to mate with a receptacle on a mounting structure to hold said container in place.

13. A container with a construction adapted to removably attach it to a turntable with said container being supported by a rotatable support structure, said container having a bottom wall, and at least one side wall extending upwardly from said bottom wall, said at least one side wall having an innermost portion and an outermost portion when supported by said rotatable support structure, said container having a holding structure to mate with a corresponding holding structure on said turntable to hold said container on said rotatable support structure despite downward pressure placed on the uppermost edge of said outermost portion of said at least one side wall, in which said turntable has a central rotational axis and said innermost portion of said at least one side wall extends towards said axis when resting upon said rotatable support structure, said holding structure comprising a locking structure for engaging with a mating locking structure near said axis by movement of said container in a radial direction towards said axis.

14. A container with a construction adapted to removably attach it to a turntable with said container being supported by a rotatable support structure, said container having a bottom wall, and at least one side wall extending upwardly from said bottom wall, said at least one side wall having an innermost portion and an outermost portion when resting on said rotatable support structure, said container having a holding structure to mate with a corresponding holding structure an said turntable to hold said container on said rotatable support structure despite downward pressure placed on the uppermost edge of said outermost portion of said at least one side wall, in which said turntable has a central rotational axis and said innermost portion of said at least one side wall extends towards said axis when resting upon said rotatable support structure, said holding structure comprising a locking structure for engaging with a mating locking structure near said axis by movement of said container in a radial direction towards said axis, said locking structure including an extension shaped to fit under a member on said turntable to hold said container against forces tending to urge said uppermost edge of said outermost portion of said at least one side wall radially outwardly from said axis.

15. A container as in claim 14 in which said holding structure includes at least a portion of said bottom wall of said container which is recessed upwardly from said bottom edge and shaped to receive an upward projection from said platform with a friction fit.

16. A container with a construction adapted to removably attach it to a turntable with said container being supported by a rotatable support structure, said container having a bottom wall, and at least one side wall extending upwardly from said bottom wall, said at least one side wall having an innermost portion and an outermost portion when supported by said rotatable support structure, said container having a holding structure to mate with a corresponding holding structure an said turntable to hold said container on said rotatable support structure despite downward pressure placed on the uppermost edge of said outermost portion of said at least one side wall, in which said container has a top wall joined to said at least one side wall, said top wall having an opening with a removable cover, and said bottom wall having an outlet opening, and a dispensing mechanism in said container operable from without said container for dispensing pre-measure quantities of particulate materials downwardly through said outlet opening.

17. A container for granular materials comprising a bottom wall, at least one side wall joined to said bottom wall, said at least one side wall having a first and second sections forming an acute angle between them, and a third section joining said first and second sections to form a housing having a generally pie-shaped cross-section, a top wall covering said housing, said top wall having a wide end and a narrow end, said wide end sloping downwardly and joining said third wall at an acute angle and having an opening with a removable cover, and including an opening in said narrow end of said top wall, and a removable cover and grille to provide a shaker outlet for said container.

18. A container for granular materials comprising a bottom wall, at least one side wall joined to said bottom wall, said at least one side wall having first and second sections forming an acute angle between them, and a third section joining said first and second sections to form a housing having a generally pie-shaped cross-section, a top wall covering said housing, said top wall having a wide end and a narrow end, said wide end sloping downwardly and joining said third wall section at an acute angle, and having an opening with a removable cover, said container including a lateral projection from said side wall at said narrow end in a direction away from said third section, said projection being positioned to fit under a member on a mounting structure to hold it in place.

* * * * *